US008648272B2

(12) United States Patent
Nakase et al.

(10) Patent No.: US 8,648,272 B2
(45) Date of Patent: Feb. 11, 2014

(54) BRACKET AND SHELL ASSEMBLY HOUSING A PUSH BUTTON SWITCH

(75) Inventors: Yusho Nakase, Yokohama (JP); Liang Sun, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 196 days.

(21) Appl. No.: 13/236,069

(22) Filed: Sep. 19, 2011

(65) Prior Publication Data

US 2012/0090967 A1 Apr. 19, 2012

(30) Foreign Application Priority Data

Oct. 14, 2010 (CN) ..... 2010 1 0507048

(51) Int. Cl.
*H01H 1/64* (2006.01)

(52) U.S. Cl.
USPC ..... 200/293

(58) Field of Classification Search
USPC ..... 200/293
See application file for complete search history.

(56) References Cited

U.S. PATENT DOCUMENTS 5,329,083 A * 7/1994 Lai ..... 200/302.2

FOREIGN PATENT DOCUMENTS

| | | |
|---|---|---|
| CN | 101042962 | 9/2007 |
| CN | 101097810 | 1/2008 |
| TW | 200620357 | 6/2006 |

* cited by examiner

*Primary Examiner* — Vanessa Girardi
(74) *Attorney, Agent, or Firm* — Ming Chieh Chang; Wei Te Chung

(57) ABSTRACT

A bracket and shell assembly (100) includes a bracket (1) having a base portion (11) and a tail portion (14) connecting to the base portion, a switch unit (2) assembled on the base portion of the bracket, and a shell (3) covering the bracket for shielding the switch unit. The shell defines an opening (31) and a button (4) extends through the opening of the shell to be located over the switch unit. A protrusion (141) is formed on one of the tail portion and the shell. A notch (32) is defined on the other one of the tail portion and the shell. The notch correspondingly receives the protrusion for pre-mounting the shell on the bracket.

10 Claims, 2 Drawing Sheets

BRACKET AND SHELL ASSEMBLY HOUSING A PUSH BUTTON SWITCH

BACKGROUND OF THE INVENTION

1. Field of the Invention

The present invention relates generally to an electrical connector assembly, and more particularly to pre-mounted components of an electrical connector assembly for subsequent laser-welding.

2. Description of Related Arts

A bracket and shell assembly comprises a bracket, a switch unit assembled on the bracket, and a shell covering the bracket for shielding the switch unit. The shell is rigid and prevents the switch unit from being polluted, scrapped, etc. The shell defines an opening at a top thereof. A button is located in the opening over the switch unit before the switch unit is triggered. A user pushes the button down and the switch unit is triggered by the button. Electrical connection is achieved in the switch unit thereby. The bracket and the shell are usually laser-welded with each other. However, offset may occur between the bracket and the shell if directly laser-welding the shell on the bracket without any pre-mounting steps.

Hence, an electrical connector assembly that precisely positions its bracket and shell is desired to overcome the aforementioned disadvantage of the prior art.

SUMMARY OF THE INVENTION

Accordingly, an object of the present invention is to provide an electrical connector assembly that precisely positions its bracket and shell.

To achieve the above object, a bracket and shell assembly includes a bracket having a base portion and a tail portion connecting to the base portion, a switch unit assembled on the base portion of the bracket, and a shell covering the bracket for shielding the switch unit. The shell defines an opening and a button extends through the opening of the shell to be located over the switch unit. A protrusion is formed on one of the tail portion and the shell. A notch is defined on the other one of the tail portion and the shell. The notch correspondingly receives the protrusion for pre-mounting the shell on the bracket.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
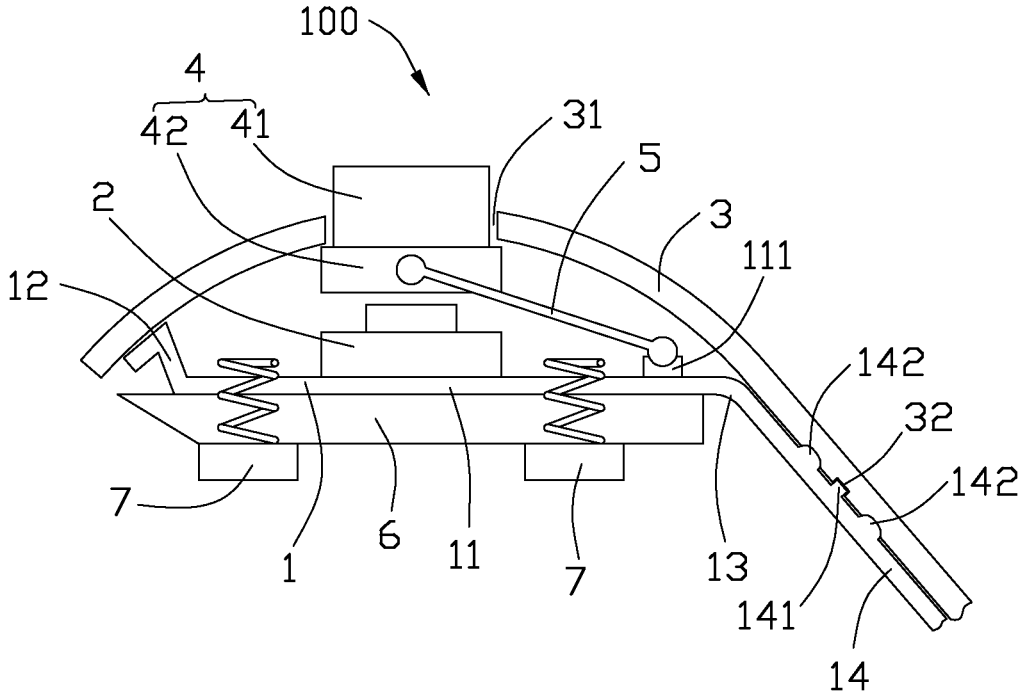
FIG. 1 is a side plan view of an electrical connector assembly constructed in accordance with the present invention.
Figure 2:
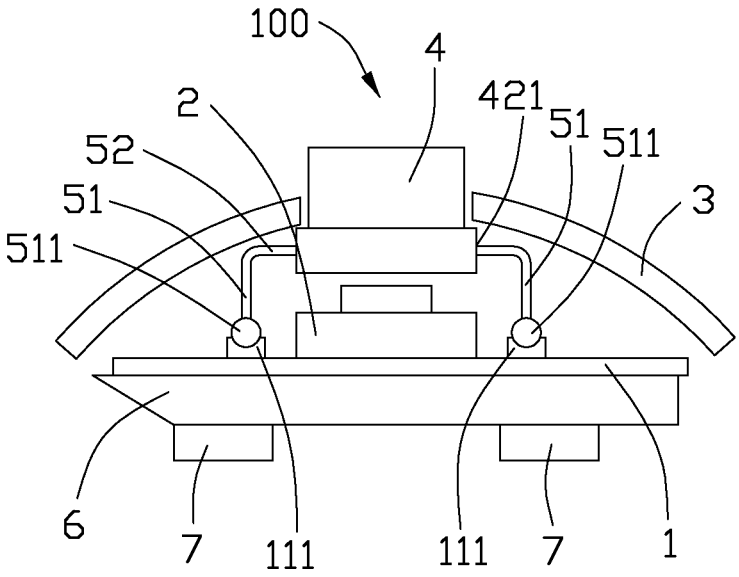
FIG. 2 is another side plan view of the electrical connector assembly.

Referring to FIGS. 1-2, a bracket and shell assembly 100 in accordance with the present invention, comprises a bracket 1, a switch unit 2 assembled on the bracket 1, and a shell 3 covering the bracket 1 for shielding the switch unit 2. The shell 3 defines an opening 31 at a top thereof. The bracket and shell assembly 100 comprises a button 4 being located over the switch unit 2 in the opening 31 for triggering the switch unit 2. In a preferred embodiment of the present invention, the bracket and shell assembly 100 further comprises a shaft 5 pivotally assembled between the bracket 1 and the button 4 for balancing force generated by the button 4 when a user presses against the button 4.

Referring to FIG. 1, the bracket 1 comprises a base portion 11, a fulcrum portion 12 curvedly upwardly extending from a left end of the base portion 11, a bending portion 13 slantwise and downward extending from a right end of the base portion 11, and a tail portion 14 linearly extending from the bending portion 13. The bracket 1 forms a pair of holding portions 111 on the base portion 11. The holding portions 111 are located at a same side of the switch unit 2. The holding portions 111 space away from the switch unit 2 a same distance. The fulcrum portion 12 and the bending portion 13 both elastically support the shell 1 without interference. The tail portion 14 forms a protrusion 141 and the shell 3 defines a notch 32 receiving the protrusion 141 for pre-mounting the shell 3 on the bracket 1.

Referring to FIG. 1, the switch unit 2 comprises a moveable contact (not shown) and an immoveable contact (not shown) located below the movable contact. The moveable contact is usually arc-shaped. The moveable contact is deformed by the button 4 towards the immoveable contact to contact with the immoveable contact, and therefore the switch unit 2 is triggered. The moveable contact disengages away from the immoveable contact when the force generated on the button 4 is removed and therefore, the switch unit 2 stops working. The principle of the switch unit 2 is well-known to persons skilled in the art and it will not be described in detail herein.

Referring to FIG. 1, the button 4 comprises an operating portion 41 at an upper part thereof and an urging member 42 at a lower part thereof. The urging member 42 has a size larger than that of the operating portion 41 and therefore, the operating portion 41 extends out of the shell 3 through the opening 31 and the urging member 42 is fixedly located beneath the shell 3. The urging member 42 keeps a certain distance away from the switch unit 2 when the operating portion 41 is not pressed down by the user and is moveable towards the switch unit 2 when the operating portion 41 is pressed down by the user. The urging member 42 defines a recess 421 extending from a left side to a right side thereof.

Referring to FIGS. 1 and 2, the shaft 5 is U-shaped and has a pair of arm portions 51 and a transverse portion 52 connecting with the arm portions 51. Each arm portion 51 forms a distal end 511 pivotally received in the holding portions 111 of the bracket 1. The transverse portion 52 is pivotally received in the recess 421 of the urging member 42. Therefore, the shaft 5 is rotatably assembled on the bracket 1 and the button 4. The shaft 5 balances to the pressing force generated on the button 4 by the user.

Referring to FIGS. 1 and 2, in a preferred embodiment, the electrical connector assembly 100 comprises a reinforcing plate 6 below the bracket 1 and a pair of securing elements 7 screwing the reinforcing plate 6 to the bracket 1.

In the present electrical connector assembly 100, the shell 3 is pre-mounted on the bracket 1 via the protrusion 141 and the notch 32 and therefore, a plurality of laser-welding portions 142 is precisely controlled on the tail portion 14 of the bracket 1 and the shell 3. Understandably, a varied design where the protrusion is formed on the shell 3 and the notch is defined on the bracket 1 is also feasible. In a preferred embodiment, the laser-welding portions 142 are two and symmetrical to each other relative to the protrusion 141 and the notch 32.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A bracket and shell assembly comprising:

a bracket having a base portion, a fulcrum portion and a bending portion extending from two opposite ends of the base portion, and a tail portion connecting to the bending portion;

a switch unit assembled on the base portion of the bracket;

a shell covering the bracket for shielding the switch unit and supported by the bracket at the fulcrum portion and the tail portion;

an opening defined in the shell above the switch unit; and a button extending through the opening of the shell to be located over the switch unit; wherein the tail portion of the bracket is welded with the shell for securing the shell to the bracket in a final assembly, and a notch and protrusion mechanism is provided between the bracket and the shell for a temporary retention therebetween for initial alignment.

2. The bracket and shell assembly as claimed in claim 1, wherein the notch and protrusion mechanism is located around the tail portion.

3. The bracket and shell assembly as claimed in claim 1, wherein the fulcrum portion and the bending portion together elastically support the shell.

4. The bracket and shell assembly as claimed in claim 1, further comprising a shaft pivotally assembled between the button and the bracket.

5. The bracket and shell assembly as claimed in claim 4, wherein the shaft comprises a pair of arm portions and a transverse portion connecting with the arm portions.

6. The bracket and shell assembly as claimed in claim 5, wherein the base portion defines a pair of holding portions, the button defines a recess, and the arm portions have distal ends pivotally received in the holding portions and the transverse portion is pivotally received in the recess.

7. The bracket and shell assembly as claimed in claim 6, wherein the holding portions are located at a same side of the switch unit.

8. The bracket and shell assembly as claimed in claim 6, wherein the holding portions space away from the switch unit a same distance.

9. The bracket and shell assembly as claimed in claim 6, wherein the button comprises an operating portion extending through the opening and an urging member located beneath the operating portion, and wherein the recess is defined on the urging member.

10. The bracket and shell assembly as claimed in claim 9, wherein the urging member has a size larger than that of the operating portion.

* * * * *